US011220856B2

(12) United States Patent
Axtolis

(10) Patent No.: US 11,220,856 B2
(45) Date of Patent: Jan. 11, 2022

(54) MOVABLE BARRIER OPERATOR ENHANCEMENT DEVICE AND METHOD

(71) Applicant: The Chamberlain Group LLC, Oak Brook, IL (US)

(72) Inventor: Robert Jude Axtolis, Naperville, IL (US)

(73) Assignee: The Chamberlain Group LLC, Oak Brook, IL (US)

( * ) Notice: Subject to any disclaimer, the term of this patent is extended or adjusted under 35 U.S.C. 154(b) by 0 days.

(21) Appl. No.: 16/838,351

(22) Filed: Apr. 2, 2020

(65) Prior Publication Data

US 2020/0318414 A1 Oct. 8, 2020

Related U.S. Application Data

(60) Provisional application No. 62/828,858, filed on Apr. 3, 2019.

(51) Int. Cl.

| | |
|---|---|
| ***E05F 15/77*** | (2015.01) |
| ***G07C 9/00*** | (2020.01) |
| *E05F 15/668* | (2015.01) |

(52) U.S. Cl.

CPC ..... *E05F 15/77* (2015.01); *G07C 9/00309* (2013.01); *G07C 9/00896* (2013.01); (Continued)

(58) Field of Classification Search

CPC ..... E05F 15/77; G07C 9/00

See application file for complete search history.

(56) References Cited

U.S. PATENT DOCUMENTS

| | | | |
|---|---|---|---|
| 803,047 | A | 10/1905 | Browne |
| 4,360,807 | A | 11/1982 | Zettergren |

(Continued)

FOREIGN PATENT DOCUMENTS

| | | |
|---|---|---|
| CN | 106951253 | 7/2017 |
| DE | 102010015104 | 11/1957 |

(Continued)

OTHER PUBLICATIONS

US 7,902,994 B2, 03/2011, Geerlings (withdrawn)

(Continued)

*Primary Examiner* — K. Wong

(74) *Attorney, Agent, or Firm* — Fitch, Even, Tabin & Flannery LLP

(57) ABSTRACT

In one aspect, a movable barrier operator enhancement device is provided that includes communication circuitry configured to transmit a radio frequency control signal to a movable barrier operator and a memory configured to store a first transmitter identification (ID) and a changing code for the radio frequency control signal. The device includes a processor configured to change the first transmitter ID to a second transmitter ID in response to a determination of a transmitter ID change event. The communication circuitry is configured to receive a state change request for the movable barrier operator from a remote computing device. The processor is configured to cause the communication circuitry to transmit a radio frequency control signal including the second transmitter ID to the movable barrier operator in response to the communication circuitry receiving the state change request.

28 Claims, 4 Drawing Sheets

(52) U.S. Cl.
CPC ..... *E05F 15/668* (2015.01); *E05Y 2900/106* (2013.01); *G07C 2009/00769* (2013.01); *G07C 2009/00928* (2013.01)

(56) References Cited

U.S. PATENT DOCUMENTS 4,464,651 A 8/1984 Duhame
5,220,263 A 6/1993 Onishi
5,565,843 A 10/1996 Meyvis
5,596,317 A 1/1997 Brinkmeyer
5,614,891 A 3/1997 Zeinstra
5,661,804 A * 8/1997 Dykema ..... G07C 9/00182 380/262
5,872,513 A 2/1999 Fitzgibbon
6,025,785 A 2/2000 Farris
6,037,858 A 3/2000 Seki
6,130,602 A 10/2000 O'Toole
6,137,421 A 10/2000 Dykema
6,140,938 A 10/2000 Flick
6,167,137 A 12/2000 Marino
6,229,434 B1 5/2001 Knapp
6,239,569 B1 5/2001 Fitzgibbon
6,271,765 B1 8/2001 King
6,278,249 B1 8/2001 Fitzgibbon
6,308,083 B2 10/2001 King
6,326,754 B1 12/2001 Mullet
6,366,051 B1 4/2002 Nantz
6,396,446 B1 5/2002 Walstra
6,484,784 B1 11/2002 Weik, III
6,615,132 B1 9/2003 Nagasaka
6,624,605 B1 9/2003 Powder
6,658,328 B1 12/2003 Alrabady
6,703,941 B1 3/2004 Blaker
6,778,064 B1 8/2004 Yamasaki
6,861,942 B1 3/2005 Knapp
6,917,801 B2 7/2005 Witte
6,963,270 B1 11/2005 Gallagher, III
6,978,126 B1 12/2005 Blaker
7,038,409 B1 5/2006 Mullet
7,088,265 B2 8/2006 Tsui
7,113,090 B1 9/2006 Saylor
7,205,892 B2 4/2007 Luebke
7,205,908 B2 4/2007 Tsui
7,221,256 B2 5/2007 Skekloff
7,257,426 B1 8/2007 Witkowski
7,266,344 B2 9/2007 Rodriquez
7,289,014 B2 10/2007 Mullet
7,290,886 B2 11/2007 Cheng
7,315,143 B2 1/2008 Mullet
7,346,374 B2 3/2008 Witkowski
7,349,722 B2 3/2008 Witkowski
7,468,676 B2 12/2008 Styers
7,469,129 B2 12/2008 Blaker
7,493,140 B2 2/2009 Michmerhuizen
7,493,726 B2 2/2009 Fitzgibbon
7,532,965 B2 5/2009 Robillard
7,602,283 B2 10/2009 John
7,710,284 B2 5/2010 Dzurko
7,839,263 B2 11/2010 Shearer
7,864,070 B2 1/2011 Witkowski
7,869,582 B2 1/2011 Styers
7,889,050 B2 2/2011 Witkowski
7,911,358 B2 3/2011 Bos
7,920,601 B2 4/2011 Andrus
7,970,446 B2 6/2011 Witkowski
7,973,678 B2 7/2011 Petricoin, Jr.
7,979,173 B2 7/2011 Breed
8,000,667 B2 8/2011 Witkowski
8,040,217 B2 10/2011 Fitzgibbon
8,049,595 B2 11/2011 Olson
8,103,655 B2 1/2012 Srinivasan
8,111,179 B2 2/2012 Turnbull
8,138,883 B2 3/2012 Shearer
8,174,357 B2 5/2012 Geerlings
8,200,214 B2 6/2012 Chutorash
8,208,888 B2 6/2012 Chutorash
8,218,739 B2 7/2012 Styers
8,253,528 B2 8/2012 Blaker
8,264,333 B2 9/2012 Blaker
8,284,021 B2 * 10/2012 Farris ..... H04W 12/80 340/5.71
8,311,490 B2 11/2012 Witkowski
8,330,569 B2 12/2012 Blaker
8,384,513 B2 2/2013 Witkowski
8,384,580 B2 2/2013 Witkowski
8,410,930 B2 4/2013 Karasek
8,494,547 B2 7/2013 Nigon
8,531,266 B2 9/2013 Shearer
8,536,977 B2 * 9/2013 Fitzgibbon ..... G07C 9/00309 340/5.23
8,587,404 B2 11/2013 Laird
8,634,888 B2 1/2014 Witkowski
8,643,465 B2 2/2014 Fitzgibbon
8,837,608 B2 9/2014 Witkowski
8,843,066 B2 9/2014 Chutorash
8,878,646 B2 11/2014 Chutorash
8,918,244 B2 12/2014 Brzezinski
8,981,898 B2 3/2015 Sims
9,007,168 B2 4/2015 Bos
9,024,801 B2 5/2015 Witkowski
9,122,254 B2 9/2015 Cate
9,141,099 B2 9/2015 Cate
9,189,952 B2 11/2015 Chutorash
9,229,905 B1 1/2016 Penilla
9,230,378 B2 1/2016 Chutorash
9,264,085 B2 2/2016 Pilat
9,318,017 B2 4/2016 Witkowski
9,324,230 B2 4/2016 Chutorash
9,367,978 B2 6/2016 Sullivan
9,370,041 B2 6/2016 Witkowski
9,396,598 B2 7/2016 Daniel-Wayman
9,430,939 B2 8/2016 Shearer
9,443,422 B2 9/2016 Pilat
9,449,449 B2 9/2016 Evans
9,539,930 B2 1/2017 Geerlings
9,552,723 B2 1/2017 Witkowski
9,576,408 B2 2/2017 Hendricks
9,614,565 B2 4/2017 Pilat
9,620,005 B2 4/2017 Geerlings
9,640,005 B2 5/2017 Geerlings
9,652,907 B2 5/2017 Geerlings
9,652,978 B2 5/2017 Wright
9,679,471 B2 6/2017 Geerlings
9,691,271 B2 6/2017 Geerlings
9,711,039 B2 7/2017 Shearer
9,715,772 B2 7/2017 Bauer
9,715,825 B2 7/2017 Geerlings
9,756,233 B2 9/2017 Lee
9,791,861 B2 10/2017 Keohane
9,811,085 B1 11/2017 Hayes
9,811,958 B1 11/2017 Hall
9,819,498 B2 11/2017 Vuyst
9,836,905 B2 12/2017 Chutorash
9,836,955 B2 12/2017 Papay
9,836,956 B2 12/2017 Shearer
9,858,806 B2 1/2018 Geerlings
9,875,650 B2 1/2018 Witkowski
9,916,769 B2 3/2018 Wright
9,922,548 B2 3/2018 Geerlings
9,947,159 B2 4/2018 Geerlings
9,965,947 B2 5/2018 Geerlings
9,984,516 B2 5/2018 Geerlings
10,008,109 B2 6/2018 Witkowski
10,045,183 B2 8/2018 Chutorash
10,060,175 B1 8/2018 Lickfelt
10,062,229 B2 8/2018 Zeinstra
10,096,186 B2 10/2018 Geerlings
10,096,188 B2 10/2018 Geerlings
10,097,680 B2 10/2018 Bauer
10,127,804 B2 11/2018 Geerlings
10,138,671 B2 * 11/2018 Fitzgibbon ..... E05F 15/60
10,147,310 B2 12/2018 Geerlings
10,163,337 B2 12/2018 Geerlings
10,163,366 B2 12/2018 Wright

(56) References Cited

U.S. PATENT DOCUMENTS

| | | | |
|---|---|---|---|
| 10,176,708 | B2 | 1/2019 | Geerlings |
| 10,198,938 | B2 | 2/2019 | Geerlings |
| 10,217,303 | B1 | 2/2019 | Hall |
| 10,229,548 | B2 | 3/2019 | Daniel-Wayman |
| 10,282,977 | B2 | 5/2019 | Witkowski |
| 10,358,859 | B2 | 7/2019 | Lickfelt |
| 10,553,050 | B1 | 2/2020 | Romero |
| 10,597,928 | B2 * | 3/2020 | Cate ..... E05F 15/40 |
| 10,614,650 | B2 | 4/2020 | Minsley |
| 10,837,217 | B2 | 11/2020 | Cate |
| 10,846,956 | B2 | 11/2020 | Cate |
| 10,907,398 | B2 | 2/2021 | Cate |
| 10,997,710 | B2 | 5/2021 | Vajaria |
| 10,997,810 | B2 | 5/2021 | Atwell |
| 11,074,773 | B1 | 7/2021 | Morris |
| 11,122,430 | B2 | 9/2021 | Fitzgibbon |
| 2002/0083178 | A1 | 6/2002 | Brothers |
| 2002/0183008 | A1 | 12/2002 | Menard |
| 2003/0025793 | A1 | 2/2003 | Mcmahon |
| 2003/0051155 | A1 | 3/2003 | Martin |
| 2003/0071590 | A1 | 4/2003 | Roman |
| 2003/0118187 | A1 | 6/2003 | Fitzgibbon |
| 2003/0140107 | A1 | 7/2003 | Rezvani |
| 2003/0141987 | A1 | 7/2003 | Hayes |
| 2003/0190906 | A1 | 10/2003 | Winick |
| 2004/0046639 | A1 | 3/2004 | Giehler |
| 2004/0054906 | A1 | 3/2004 | Carro |
| 2004/0212498 | A1 | 10/2004 | Peterson |
| 2004/0257200 | A1 | 12/2004 | Baumgardner |
| 2005/0012631 | A1 | 1/2005 | Gregori |
| 2005/0024230 | A1 | 2/2005 | Chuey |
| 2005/0060555 | A1 | 3/2005 | Raghunath |
| 2005/0151667 | A1 | 7/2005 | Hetzel |
| 2005/0176400 | A1 | 8/2005 | Mullet |
| 2005/0195066 | A1 | 9/2005 | Vandrunen |
| 2006/0020796 | A1 | 1/2006 | Aura |
| 2006/0097843 | A1 | 5/2006 | Libin |
| 2006/0103503 | A1 | 5/2006 | Rodriquez |
| 2006/0158339 | A1 | 7/2006 | Brundula |
| 2006/0164208 | A1 | 7/2006 | Schaffzin |
| 2006/0224512 | A1 | 10/2006 | Kurakata |
| 2006/0232377 | A1 | 10/2006 | Witkowski |
| 2007/0146118 | A1 | 6/2007 | Rodriguez |
| 2007/0167138 | A1 | 7/2007 | Bauman |
| 2008/0194291 | A1 | 8/2008 | Martin |
| 2008/0224886 | A1 | 9/2008 | Rodriguez et al. |
| 2008/0291047 | A1 | 11/2008 | Summerford |
| 2008/0303630 | A1 | 12/2008 | Martinez |
| 2009/0313095 | A1 | 12/2009 | Hurpin |
| 2009/0315672 | A1 | 12/2009 | Nantz et al. |
| 2010/0029261 | A1 | 2/2010 | Mikkelsen |
| 2010/0060413 | A1 | 3/2010 | Fitzgibbon et al. |
| 2010/0159846 | A1 | 6/2010 | Witkowski |
| 2011/0037574 | A1 | 2/2011 | Pratt |
| 2011/0218965 | A1 | 9/2011 | Lee |
| 2011/0225451 | A1 | 9/2011 | Leggette |
| 2011/0227698 | A1 | 9/2011 | Witkowski |
| 2011/0273268 | A1 | 11/2011 | Bassali |
| 2011/0287757 | A1 | 11/2011 | Nykoluk |
| 2012/0133841 | A1 | 5/2012 | Vanderhoff |
| 2012/0191770 | A1 | 7/2012 | Perlmutter |
| 2012/0254960 | A1 | 10/2012 | Lortz |
| 2013/0017812 | A1 | 1/2013 | Foster |
| 2013/0063243 | A1 | 3/2013 | Witkowski |
| 2013/0088326 | A1 | 4/2013 | Bassali |
| 2013/0147600 | A1 | 6/2013 | Murray |
| 2013/0304863 | A1 | 11/2013 | Reber |
| 2014/0125499 | A1 | 5/2014 | Cate |
| 2014/0245284 | A1 | 8/2014 | Alrabady |
| 2014/0266589 | A1 | 9/2014 | Wilder |
| 2014/0282929 | A1 | 9/2014 | Tse |
| 2014/0327690 | A1 | 11/2014 | Mcguire |
| 2014/0361866 | A1 | 12/2014 | Evans |
| 2015/0022436 | A1 | 1/2015 | Cho |
| 2015/0084750 | A1 | 3/2015 | Fitzgibbon |
| 2015/0139423 | A1 | 5/2015 | Hildebrandt |
| 2015/0161832 | A1 | 6/2015 | Esselink |
| 2015/0187019 | A1 | 7/2015 | Fernandes |
| 2015/0222436 | A1 | 8/2015 | Morten |
| 2015/0235172 | A1 | 8/2015 | Hall |
| 2015/0235173 | A1 | 8/2015 | Hall |
| 2015/0235493 | A1 | 8/2015 | Hall |
| 2015/0235495 | A1 | 8/2015 | Hall |
| 2015/0261521 | A1 | 9/2015 | Choi |
| 2015/0310737 | A1 | 10/2015 | Simanowski |
| 2015/0310765 | A1 | 10/2015 | Wright |
| 2016/0009188 | A1 | 1/2016 | Yokoyama |
| 2016/0010382 | A1 | 1/2016 | Cate |
| 2016/0020813 | A1 | 1/2016 | Pilat |
| 2016/0043762 | A1 | 2/2016 | Turnbull |
| 2016/0101736 | A1 | 4/2016 | Geerlings |
| 2016/0104374 | A1 | 4/2016 | Ypma |
| 2016/0125357 | A1 | 5/2016 | Hall |
| 2016/0145903 | A1 | 5/2016 | Taylor |
| 2016/0194912 | A1 | 7/2016 | Fitzgibbon |
| 2016/0196706 | A1 | 7/2016 | Tehranchi |
| 2016/0203721 | A1 | 7/2016 | Wright |
| 2016/0359629 | A1 | 12/2016 | Nadathur |
| 2017/0061110 | A1 | 3/2017 | Wright |
| 2017/0079082 | A1 | 3/2017 | Papay |
| 2017/0113619 | A1 | 4/2017 | Boehm |
| 2017/0140643 | A1 | 5/2017 | Puppo |
| 2017/0230509 | A1 | 8/2017 | Lablans |
| 2017/0241189 | A1 | 8/2017 | Fitzgibbon |
| 2017/0316628 | A1 | 11/2017 | Farber |
| 2017/0320464 | A1 | 11/2017 | Schultz |
| 2017/0323498 | A1 | 11/2017 | Bauer |
| 2017/0352286 | A1 | 12/2017 | Witkowski |
| 2017/0364719 | A1 | 12/2017 | Boehm |
| 2017/0372574 | A1 | 12/2017 | Linsky |
| 2018/0052860 | A1 | 2/2018 | Hayes |
| 2018/0053237 | A1 | 2/2018 | Hayes |
| 2018/0118045 | A1 | 5/2018 | Gruzen |
| 2018/0123806 | A1 | 5/2018 | Vuyst |
| 2018/0184376 | A1 | 6/2018 | Geerlings |
| 2018/0225959 | A1 | 8/2018 | Witkowski |
| 2018/0232981 | A1 | 8/2018 | Geerlings |
| 2018/0245395 | A1 | 8/2018 | Huggins |
| 2018/0246515 | A1 | 8/2018 | Iwama |
| 2018/0276613 | A1 | 9/2018 | Hall |
| 2018/0285814 | A1 | 10/2018 | Hall |
| 2018/0367419 | A1 | 12/2018 | Hall |
| 2019/0010382 | A1 | 1/2019 | Kuznetsov |
| 2019/0082149 | A1 | 3/2019 | Correnti |
| 2019/0085615 | A1 | 3/2019 | Cate |
| 2019/0102962 | A1 | 4/2019 | Miller |
| 2019/0208024 | A1 | 7/2019 | Jablonski |
| 2019/0228603 | A1 | 7/2019 | Fowler |
| 2019/0244448 | A1 | 8/2019 | Alamin |
| 2019/0249481 | A1 | 8/2019 | Cate |
| 2019/0337754 | A1 | 11/2019 | Laird |
| 2019/0392691 | A1 | 12/2019 | Cheng |
| 2020/0027054 | A1 | 1/2020 | Hall |
| 2020/0043270 | A1 | 2/2020 | Cate |
| 2020/0074753 | A1 | 3/2020 | Adiga |
| 2020/0208461 | A1 | 7/2020 | Virgin |
| 2020/0240198 | A1 | 7/2020 | Cate |
| 2020/0242862 | A1 | 7/2020 | Cate |
| 2020/0364961 | A1 | 11/2020 | Atwell |
| 2021/0019964 | A1 | 1/2021 | Cate |

FOREIGN PATENT DOCUMENTS

| | | |
|---|---|---|
| KR | 20050005150 | 1/2005 |
| KR | 20060035951 | 4/2006 |
| WO | 2008082482 | 7/2008 |
| WO | 2019157149 | 8/2019 |

OTHER PUBLICATIONS

US 10,135,479 B2, 11/2018, Turnbull (withdrawn)

U.S. Appl. No. 16/528,376; Office Action dated Aug. 18, 2020; 34 Pages.

(56) References Cited

OTHER PUBLICATIONS

U.S. Appl. No. 16/528,376; Office Action dated Aug. 18, 2020, (pp. 1-11).
U.S. Appl. No. 16/272,728; Notice of Allowance dated Sep. 28, 2020; (pp. 1-11).
U.S. Appl. No. 16/257,045; Notice of Allowance dated Jul. 9, 2020; (pp. 1-12).
U.S. Appl. No. 16/596,330; Notice of Allowance dated Jul. 8, 2020; (pp. 1-12).
Canadian Patent Application No. 2,693,580; Office Action dated Mar. 24, 2015; 4 pages.
International Search Report and Written Opinion; PCT/US2019/044358 dated Nov. 17, 2019.
Nirdhar Khazanie and Yossi Matias, Growing Eddystone with Ephemeral Identifiers: A Privacy Aware & Secure Open Beacon Format; Google Developers; Thursday, Apr. 14, 2016; 6 pages.
PCT Patent Application No. PCT/US2019/017005; International Search Report and Written Opinion dated May 19, 2019.
Summary of Spothero Product, publicly available before Aug. 1, 2018.
The Chamberlain Group, Smart Garage Hub Manual for Android Devices, 26 pages, publicly available in 2018.
The Chamberlain Group, Smart Garage Hub Manual for iOS devices, 26 pages, publicly available in 2018.
The Genie Company, Instructions for Closed Confirm™ Remote Installation and Operation, publicly available before Jan. 24, 2019, 1 page.
U.S. Appl. No. 16/257,045, filed Jan. 24, 2019; 53 pages.
U.S. Appl. No. 16/596,330, filed: Oct. 8, 2019; 65 Pages.
UL Standard for Safety for Door, Drapery, Gate, Louver, and Window Operators and Systems, UL 325 Fifth Edition, Dated Jun. 7, 2002; pp. 1-186.
U.S. Appl. No. 16/272,728; Office Action dated Jan. 15, 2020; (pp. 1-24).
U.S. Appl. No. 16/272,728; Office Action dated May 29, 2020, (pp. 1-30).
Wayback Machine archive of https://geniecompany.com/garage-door-openers/accessories/closed-confirm-remote.aspx, website publicly available as of Oct. 28, 2016, 3 pages.
YouTube Video entitled "How To Set up Tesla Model 3 Homelink . . . Super Easy!!!!" https://www.youtube.com/watch?v=nmmy4i7F05M; published Mar. 1, 2018.
U.S. Appl. No. 16/528,376; Advisory Action dated May 4, 2021; 4 pages.
About us—ParqEx, 5 pages, Wayback Machine capture dated May 5, 2018, 5 pages, retrieved from https://web.archive.org/web/20180505051951/https://www.parqex.com/about-parqex/.
SpotHero, Frequently Asked Questions, Wayback Machine capture dated Jun. 30, 2017, 3 pages, retrieved from nttps://web.archive.org/web/20170630063148/https://spothero.com/faq/.
U.S. Appl. No. 16/968,468, filed: Aug. 7, 2020; 66 pages.
U.S. Appl. No. 17/064,255, filed: Oct. 6, 2020; 57 pages.
U.S. Appl. No. 17/082,691, filed: Oct. 28, 2020; 39 pages.
Uber, Airbnb and consequences of the sharing economy: Research roundup, Harvard Kennedy School—Shorenstein Center on Media, Politics, and Public Policy, 14 pages, Jun. 3, 2016, retrieved from https://journalistsresource.org/studies/economics/business/airbnb-lyft-uber-bike-share-sharing-economy-research-roundup/.
U.S. Appl. No. 16/454,978; Notice of Allowance dated Feb. 16, 2021.
U.S. Appl. No. 16/454,978; application filed Jun. 27, 2019; 57 pages.
U.S. Appl. No. 16/454,978; Office Action dated May 8, 2020; 25 pages.
U.S. Appl. No. 16/454,978; Office Action dated Sep. 22, 2020; 36 pages.
U.S. Appl. No. 16/528,376; Office Action dated Feb. 17, 2021; (pp. 1-14).
U.S. Appl. No. 16/871,844; Notice of Allowance dated Dec. 28, 2020; 38 pages.
YouTube Video entitled Tesla Model X Auto Park in Garage (Just Crazy), https://youtu.be/BszlChMuZV4, published Oct. 2, 2016.

* cited by examiner

| Whitelist | |
|---|---|
| Transmitter ID | Rolling Code |
| 001 0000 | 000000 - 001010 |
| 000 0001 | 001010 - 010100 |
| 000 0010 | 010100 - 011110 |
| 000 0011 | 011110 - 010100 |
| 000 0100 | 010100 - 110010 |

MOVABLE BARRIER OPERATOR ENHANCEMENT DEVICE AND METHOD

CROSS-REFERENCE TO RELATED APPLICATION

This application claims the benefit of U.S. Provisional application No. 62/828,858, filed Apr. 3, 2019, which is incorporated by reference in its entirety herein.

FIELD

The present disclosure generally relates to systems and methods for controlling movable barrier operators and, more specifically, relates to systems and methods to limit unauthorized control of a movable barrier operator by a transmitter.

BACKGROUND

Many movable barrier operators, such as garage door openers, are not internet-enabled and are instead operated by transmitters such as portable transmitters that may be carried by a user on a keychain, for example, or clipped to a visor of a vehicle. A user may desire to control the user's garage door over the internet, for example, using a remote computing device such as the user's smartphone. To address this user desire without the inconvenience and/or cost of replacing the user's previously installed movable barrier operator, the user may install a movable barrier operator enhancement device or an operator enhancement device to control the user's previously installed movable barrier operator. One example operator enhancement device is the myQ® smart garage hub sold by the Chamberlain Group, Inc. The user sets up a user account and associates the operator enhancement device with the user's movable barrier operator. The user may then communicate with the operator enhancement device via a network (e.g. the internet) and a user device, such as a smartphone.

The operator enhancement device operates as a transmitter and controls the movable barrier operator in a manner similar to other transmitters. When the operator enhancement device receives a state change request from a user over the internet, the operator enhancement device transmits a radio frequency control command to the movable barrier operator and causes the movable barrier operator to carry out the requested state change. Like the radio frequency control command of other transmitters, the radio frequency control command transmitted by the operator enhancement device includes a transmitter identifier (ID), a button ID (which corresponds to a button of a portable transmitter), and a payload. The payload includes a changing code value such as a rolling code that changes with each transmission of a radio frequency control command by the operator enhancement device. The transmitter IDs for conventional operator enhancement devices and transmitters are fixed and do not change for the life of the operator enhancement device or transmitter.

A user may cause a movable barrier operator to learn multiple transmitters including a keypad transmitter, a visor-mounted transmitter in the user's car, and an operator enhancement device. When a movable barrier operator learns a transmitter, the movable barrier operator stores the transmitter ID of the transmitter in a whitelist, table, or data structure maintained in a memory of the movable barrier operator. In many situations, the only way to remove a transmitter ID from the movable barrier operator whitelist is to erase the entire whitelist and relearn the transmitters to the operator that the user still desires to control the movable barrier operator.

A problem may arise when the user sells the user's operator enhancement device or simply wishes to decommission or remove an operator enhancement device from being able to control the user's movable barrier operator. A user may mistakenly believe that using a client application executing on the user's smartphone to delete the operator enhancement device from the user's user account prevents the operator enhancement device from being able to control the user's movable barrier operator. However, because the movable barrier operator stores the transmitter ID of the operator enhancement device in the movable barrier operator whitelist, the movable barrier operator may still respond to a command from an operator enhancement device having a transmitter ID in the whitelist even if the operator enhancement device is no longer associated with the user account.

For example, Alice may give her operator enhancement device to a neighbor, Bob. Even if Bob's movable barrier operator learns the operator enhancement device, Alice's movable barrier operator may still respond to the operator enhancement device transmitter's commands if Bob's operator enhancement device (formerly Alice's) is within range of Alice's movable barrier operator. That is, Alice's movable barrier operator recognizes the transmitter ID of the operator enhancement device and may respond to control commands originating from Bob's use of a client application executing on Bob's smartphone as if the operator enhancement device were still in Alice's garage.

As another example, a user may have two or more movable barrier operators (e.g. installed in a garage with multiple doors for controlling opening/closing of the doors separately) and change the movable barrier operator associated with the operator enhancement device via the user account. Once the user has caused the new movable barrier operator to learn the operator enhancement device, both movable barrier operators will respond to a single command from the operator enhancement device.

To address these situations, a user currently erases the memory of the movable barrier operator originally paired with the operator enhancement device. However, this is inconvenient for the user because the entire whitelist of the movable barrier operator is deleted. The balance of the user's transmitters would again need to be learned by the movable barrier operator. If a user has many transmitters, this could be a difficult and time-consuming process.

DETAILED DESCRIPTION

Figure 1:
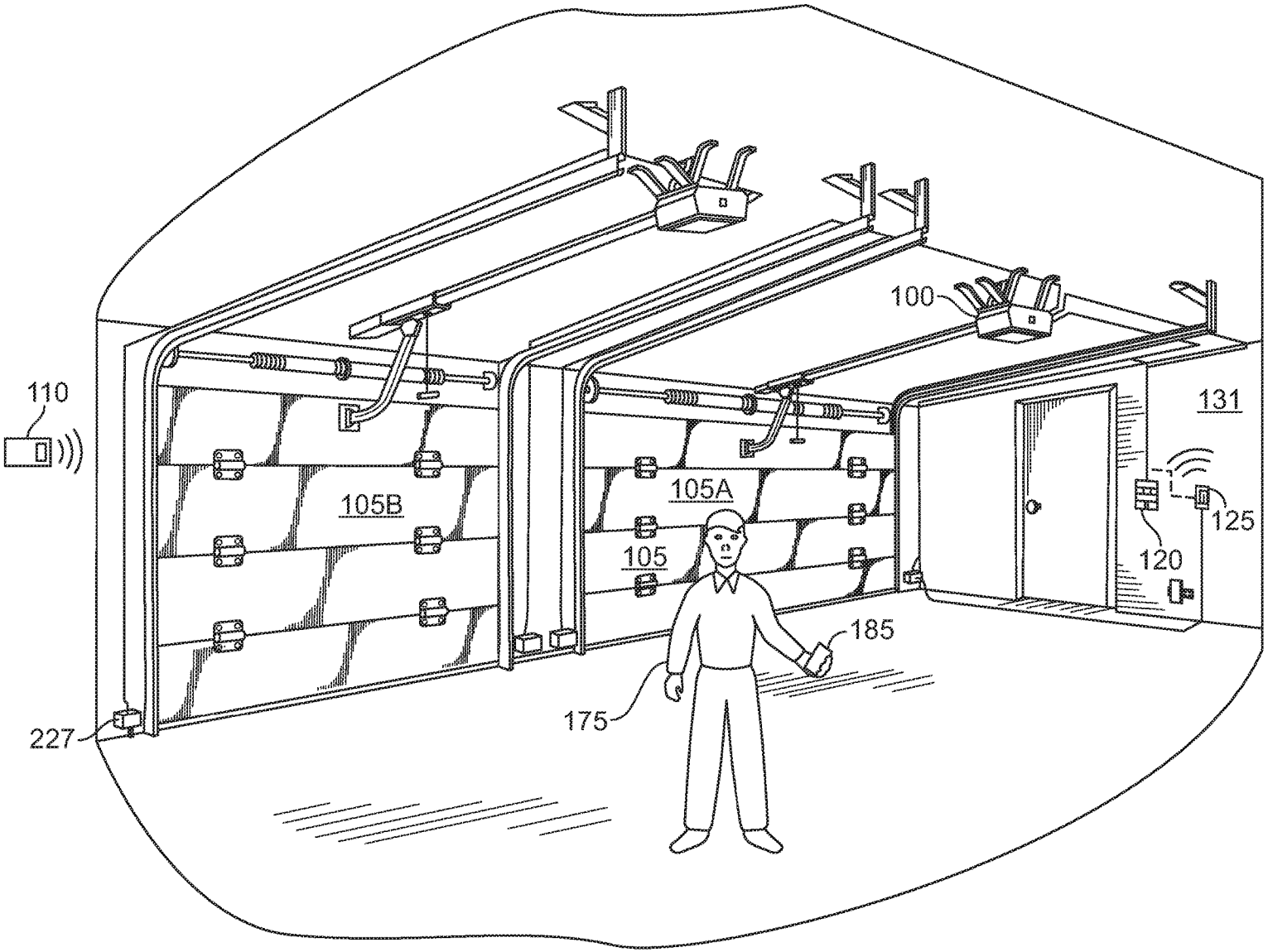
FIG. 1 is a perspective view of an example movable barrier operator system including a movable barrier operator and an operator enhancement device.

With reference to FIG. 1, a movable barrier operator, such as a garage door opener 100, is configured to move a movable barrier, such as a garage door 105, between open and closed positions. The garage door opener 100 may be configured to change the state of the garage door 105 in response to the garage door opener 100 receiving control commands from a portable transmitter 110, a keypad 115 (see FIG. 2), and an operator enhancement device 125. The subject operator enhancement device 125 provides improved security by changing the transmitter ID 130 (see FIG. 4) of the operator enhancement device 125 upon a determination of a transmitter ID change event by the operator enhancement device 125. Examples of the operator enhancement device 125 determining whether a transmitter ID change event has occurred include the operator enhancement device 125 being reset and/or paired with a new movable barrier operator 110. In this manner, a first user may simply reset the operator enhancement device 125 before transferring the operator enhancement device 125 to a second user thereby causing the operator enhancement device 125 to have a transmitter ID that is not recognized by the first user's movable barrier operator. Alternatively or additionally, when the second user pairs the operator enhancement device 125 with the second user's movable barrier operator, the operator enhancement device 125 will automatically change the transmitter ID 130 of the operator enhancement device 125 such that the hub 125 will no longer be paired for communication with the first user's movable barrier operator.

Each transmitter 110 is paired with the garage door opener 100 by placing the garage door opener 100 into the learn mode. The user may then press a button on the transmitter 110 or otherwise cause the transmitter 110 to send a radio frequency control command. When the garage door opener 100 receives the command from the transmitter 110, the garage door opener 100 may decode and/or parse the data contained in the command. The command may include a fixed code and a rolling code. The transmitter's 110 fixed code is the transmitter ID 130 (see FIG. 4) that remains the same each time the transmitter 110 sends a signal. The transmitter ID 130 is set by the manufacturer of the transmitter 110 and does not index or change. The rolling code 135, by contrast, changes each time a command is sent from the transmitter 110. Each command may also include a button ID that identifies the transmitter button pressed by the user.

During the learning mode, the movable barrier operator 110 determines the fixed code and the current rolling code of the transmitter 110. The garage door opener 100 utilizes a rolling code algorithm similar to the rolling code algorithm of the transmitter 110 to predict a range of expected rolling code values for each transmitter 110 stored in a data structure, such as a whitelist 190 (FIG. 4) maintained in a memory 140 of the garage door opener 100. The garage door opener 100 will respond to a command from a transmitter 110 if the command includes a transmitter ID 130 in the whitelist 190 and a rolling code 135 in the range of expected rolling codes. Further, the garage door opener 100 updates the range of expected rolling codes 135 for a transmitter 110 each time the garage door opener 100 receives a command from the transmitter 110.

The garage door opener 100 may also be controlled by a keypad 115 mounted outside of the garage 131 or a wall control 120. The keypad 115 and wall control 120 may communicate with the garage door opener 100 over a wired or wireless connection. In one approach, the keypad 115 or wall control 120 communicate using a wireless connection and the keypad 115 or wall control 120 may be learned by the garage door opener 100 in a manner similar to the transmitter 110.

Figure 2:
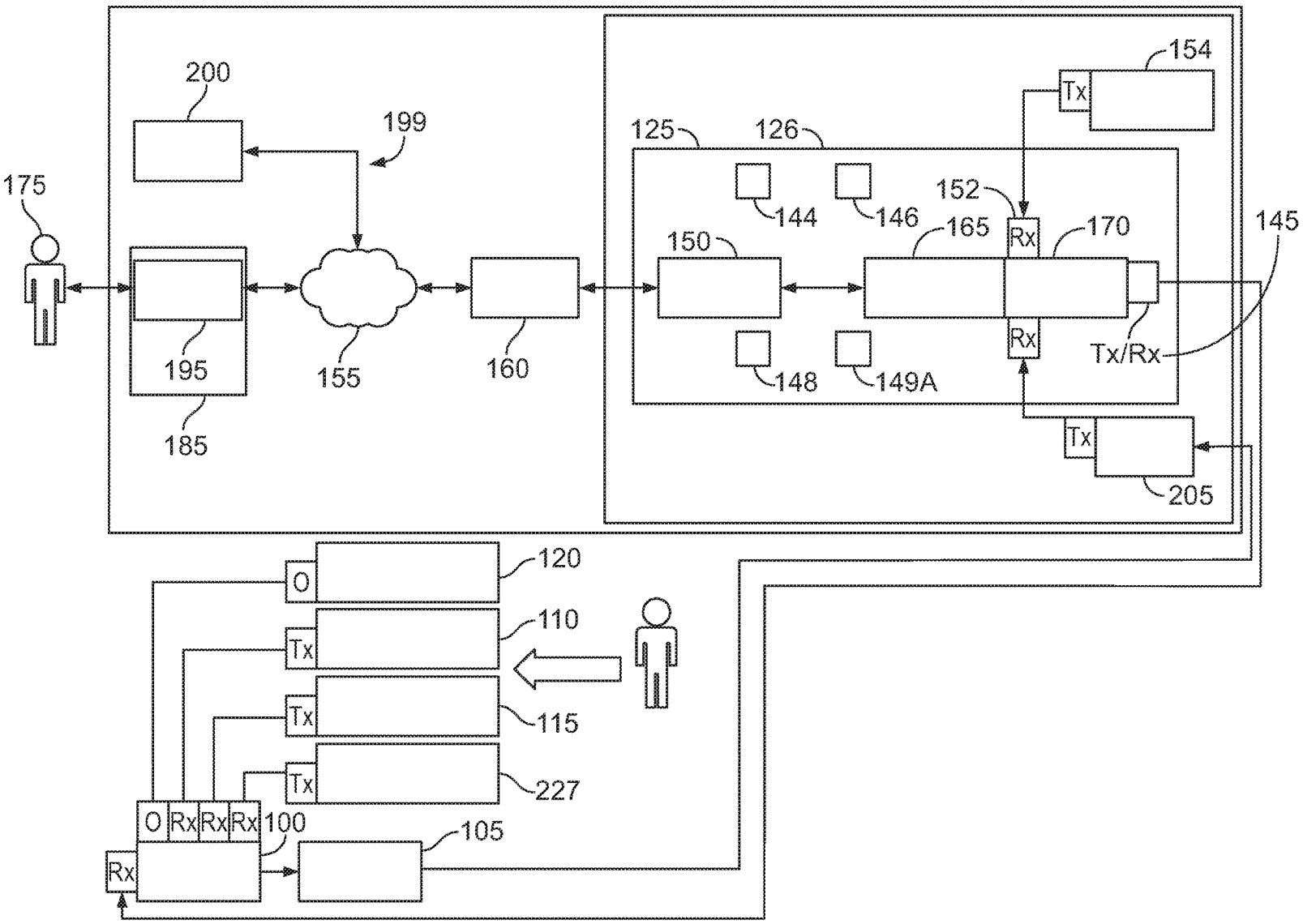
FIG. 2 is a block diagram of the system of FIG. 1.

Regarding FIG. 2, the garage door opener 100 may be controlled by the operator enhancement device 125. The operator enhancement device 125 includes a processor 144, a memory 146, and communication circuitry such as a movable barrier operator communication interface 145 and a gateway 150. The operator enhancement device 125 may also include a user interface 148, such as one or more buttons and LEDs, and/or an annunciator such as a speaker and/or a light 149A. The operator enhancement device 125 may have a housing 126 that contains some or all of the components of the operator enhancement device 125, such as the processor 144, memory 146, gateway 150, and movable barrier operator communication interface 145. The operator enhancement device 125 may also include a transmitter communication interface 152 that is configured to receive control commands from a wireless keypad 154. The wireless keypad 154 may be learned to the operator enhancement device 125, for example, by using a learning process similar to the process for learning a transmitter 110 to the garage door operator 100 described above.

The operator enhancement device 125 may also include one or more sensors 205. The one or more sensors 205 may include, for example, a door position sensor such as a tilt sensor and/or limit switch for detecting the position of the garage door 105. The one or more sensors 205 may include other sensors, such as a camera for detecting the presence of an object in the garage 131. As an example, the operator enhancement device 125 may receive a signal from a door position sensor indicative of a state (e.g., open/closed/moving) of the garage door and the operator enhancement device 125 communicates status information regarding the state of the garage door to the server computer 200. The server computer 200 provides the status information to the application 195 on the user device 185. As another example, the processor 144 may decide to refrain from causing the operator communication interface 145 from transmitting a radio frequency control signal in response to the current state of the garage door corresponding to a state of the garage door associated with a state change request the operator enhancement device 125 receives from the server computer 200.

The gateway 150 is configured to communicate with remote devices over one or more networks, such as the internet 155, using wired or wireless approaches. In the embodiment of FIG. 2, the gateway 150 is wirelessly connected to a modem, access point or router 160 and communicates over the internet 155. The gateway 150 may communicate with the router 160 using, for example, Wi-Fi or ethernet.

The processor 144 is in communication with the gateway 150 and operates an endpoint device 165 within the operator enhancement device 125. The endpoint device 165 is a logical interface for a virtual garage door opener 170 also operated by the processor 144. The virtual garage door opener 170 monitors the status of the physical garage door opener 100 that is being controlled by the operator enhancement device 125. When the sensor 205 sends a signal to the operator enhancement device 125 indicating that a status of the garage door opener 100 has changed, the virtual garage door opener 170 functions as a state machine and updates the status of the virtual garage door opener 170. The virtual garage door opener 170 also receives communications from a user device 185 over the internet 155 via the gateway 150. If the communication is a state change request, the virtual garage door opener 170 functions as a state machine and responds by causing the movable barrier operator communication interface 145 to transmit a radio frequency command to the garage door opener 100, such as in the 300 MHz-400 MHz range.

In one embodiment, a user 175 uses an application 195 (e.g. client application or browser) on a user device 185 to communicate with the operator enhancement device 125 and pair the operator enhancement device 125 to the garage door opener 100. The pairing process may involve directing the operator enhancement device 125 to send radio frequency control commands to the garage door opener 100 while the garage door opener 100 is in a learn mode. The operator enhancement device 125 is configured to communicate with a plurality of movable barrier operator types by sending communication signals by wireless communication protocols. So configured, the operator enhancement device 125 readily facilitates installation and coordination with a variety of previously installed barrier operator types. For example, the operator enhancement device is configured to communicate with all or a subset of barrier operators currently installed. Thus, a user who purchases a barrier operator feature operator enhancement device can be reasonably assured that the operator enhancement device is compatible with the user's previously installed barrier operator.

One approach for configuring communication between the operator enhancement device 125 and the previously installed garage door opener 100 includes the movable barrier operator communication interface 145 being configured to effect sending radio frequency control commands via a plurality of communication protocols to the pre-installed barrier operator 100. For example, the movable barrier operator communication interface 145 may be configured to be able to communicate with the plurality of barrier operator types by sending radio frequency control commands by a first wireless transmission protocol based on a hand-held transmitter frequency, a second wireless transmission protocol different from the first wireless transmission protocol, and/or radio frequency communications based on a frequency different from hand-held transmitter frequencies. Other approaches include radio frequency communications based on frequency hopping for spread spectrum.

By one approach, the processor 144 can wait for a period of time after causing the movable barrier operator communication interface 145 to send a radio frequency control command to the pre-installed barrier operator 100 to receive a communication indicating a response from the pre-installed barrier operator 100 before sending another radio frequency control command signal using a different protocol. The communication indicating the response from the pre-installed barrier operator can be received in a number of ways. For example, sensor 205 may be a door sensor that indicates movement of the garage door 105. In response to receiving the communication indicating the response from the pre-installed garage door opener 100, the processor 144 configures the movable barrier operator communication interface 145 to operate according to the communication protocol that effected the response from the pre-installed barrier operator 100. By this example approach, the operator enhancement device 125 may configure itself or learn the communication protocol with which the operator enhancement device 125 can communicate with the pre-installed garage door opener 100 with minimal intervention or effort on behalf of the device's user. Other approaches may be employed for configuring communications between the operator enhancement device 125 and the garage door opener 100.

With reference to FIG. 2, the gateway 150 of the operator enhancement device 125 connects to one or more networks, such as the internet 155. The one or more networks may include, for example, wide area networks (e.g., cellular, WiMAX, LoRaWAN), local area networks (e.g., a home WiFi or WiLAN network), and/or fiber optic networks. The operator enhancement device 125 is configured to receive commands from the user device 185 of the user 175 over the network 155. The user 175 may send commands to the operator enhancement device 125 via a user platform 199 (e.g. a remote computing device such as a server computer 200 and complementary client app 195) configured to communicate with the operator enhancement device 125.

In one approach, the user 175 configures a user account on user platform 199. Once the user 175 has established a user account, the user 175 identifies the garage door opener 100 (such as by providing the serial number of the garage door opener 100) to the user platform 199 and associates the garage door opener 100 with the transmitter 110, the keypad 115, and the operator enhancement device 125. In one approach, the user platform 199 includes an application 195 provided on the user device 185 and software provided on the server computer 200. The user 175 may use the application 195 to setup the user account, identify the garage door opener 100, and associate the garage door opener 100 with transmitters such as the operator enhancement device 125. The user platform 199 stores the relationships between the garage door opener 100 and the transmitters associated with the user's account. The user 175 may have to provide one or more user credentials to login to the application 195 and modify the relationships specified in the user's account.

Once the garage door opener 100 has learned the operator enhancement device, and the user 175 has associated the garage door opener 100 with the operator enhancement device 125, the user platform 199 permits the user 175 to control the garage door opener 100 with various user devices 185. The user devices 185 may include, for example, a smartphone, smartwatch, tablet computer, laptop computer, and/or personal computer. The user platform 199 may also be configured to provide information to the user 175 via the user device 185, for example, whether the garage door 105 is open or closed. The user platform 199 may also permit the user 175 to control other controllable devices associated with the user's account such as a door lock, a security system, a camera, and/or a light. An example of a user platform that may be utilized in conjunction with the disclosures of the subject application is the myQ® user platform offered by The Chamberlain Group, Inc.

For example, when the user 175 desires to change the state of the garage door 105, e.g., close or open the garage door 105, the user 175 provides an input to a user interface of the user device 185. The user device 185 communicates a state change request to the server computer 200. The server computer 200 sends a control command to the operator enhancement device 125. The operator enhancement device 125 receives the control command and the movable barrier operator communication interface 145 sends a radio frequency command signal to the garage door opener 100.

Upon the garage door opener 100 receiving the radio frequency command signal from the operator enhancement device 125, the garage door opener 100 determines whether the radio frequency command signal contains a transmitter ID 130 in the transmitter whitelist 190 (see FIG. 4) stored in the memory 140 of the garage door opener 100. If the transmitter ID 130 matches a transmitter ID 130 in the whitelist 190, and the rolling code 135 of the radio frequency command signal is within the expected range, then the garage door opener 100 carries out the command.

More specifically and with reference to FIG. 2, the user device 185 operates an application 195 that is configured to communicate directly or indirectly with the operator enhancement device 125. Upon opening the application 195, the user 175 may enter her user credentials to access the user's user account instantiated by the user platform 199. The user 175 may then select, using a graphical user interface of the application 195, the controllable device to control and the desired command. For example, the user 175 may select the device "large garage door" that may be displayed in the application 195 and may further select the command "open." The large garage door corresponds to larger paneled door 105A in FIG. 1 in contrast to the smaller paneled garage door 105B. The user device 185 sends the state change request to the server computer 200, which sends a control command to the operator enhancement device 125.

Upon receiving the control command at the gateway 150, the virtual garage door opener 170 causes the movable barrier operator communication interface 145 to send a radio frequency control command to the garage door opener 100. The radio frequency control command may include a button ID value that is representative of the button of a transmitter 110 that operated the garage door opener 100 of the larger paneled door 105A. The garage door opener 100 associated with larger paneled door 105A receives the signal from the operator enhancement device 125. The garage door opener 100 determines the transmitter ID 130 and the rolling code 135 and determines whether the transmitter ID 130 is on the whitelist 190 stored in memory 140 and whether the rolling code 135 falls within the accepted range. If the transmitter ID 130 is on the whitelist 190 and the rolling code 135 is acceptable, the garage door opener 100 performs the command. In this example, the garage door opener 100 opens the garage door 105. The movable barrier operator associated with the smaller paneled door 105B may also receive the radio frequency control command from the operator enhancement device 125 but does not respond because the button ID contained in the radio frequency control command does not match the button ID expected by the movable barrier operator of the smaller paneled door 105B.

The operator enhancement device 125 may communicate with the sensor 205 to determine whether the requested state change has been carried out by the controllable device. The controllable device may include, for example, the garage door opener 100, a door lock, a security system, a camera, and/or a light. If the controllable device is the garage door opener 100, the sensor 205 may include a tilt sensor attached to the garage door to detect the orientation of the garage door 105. For example, the tilt sensor detecting a change in the orientation of the door from vertical to horizontal indicates the garage door has opened. The sensor 205 may also include a camera, a temperature sensor, a limit switch on the track of the garage door, and/or a proximity sensor as a few examples. Upon detecting a change in the status of the garage door 105, the operator enhancement device 125 sends a status update over the network 155 to the server computer 200. The server computer 200 provides the updated status of the garage door 105 to the user 175 via the application 195.

Figure 3:
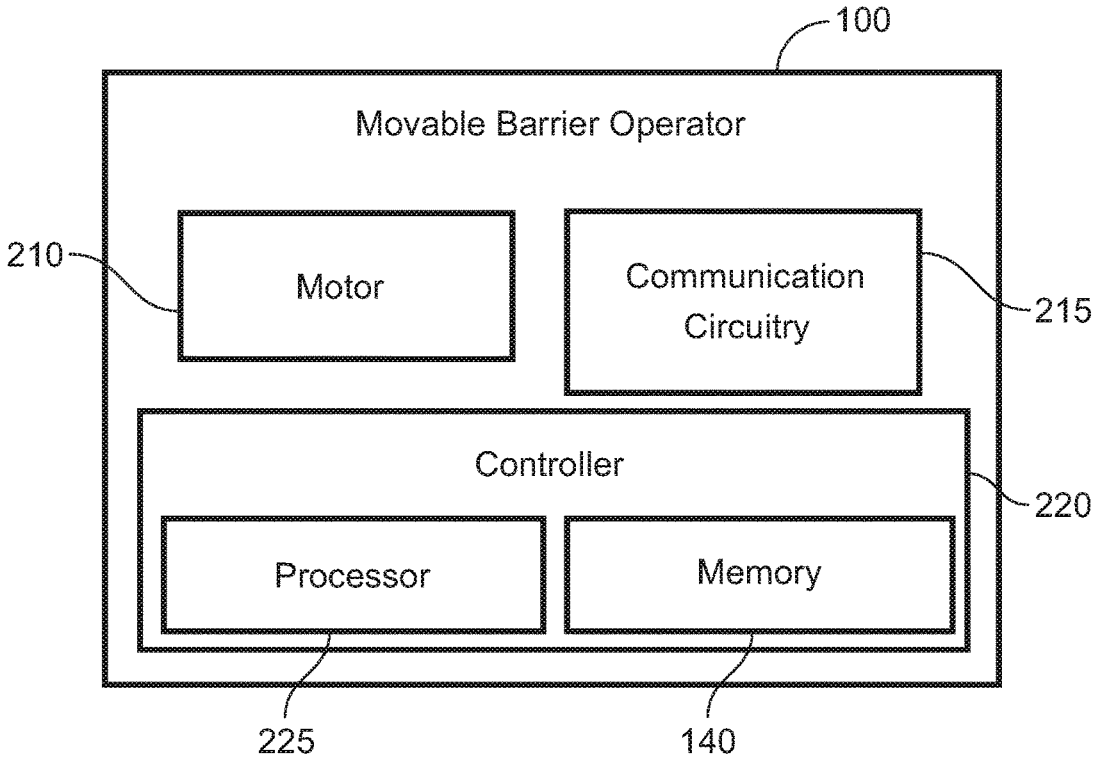
FIG. 3 is a block diagram of the movable barrier operator of FIG. 1.

With reference to FIG. 3, the garage door opener 100 may include a motor 210 or other (rotary or linear) actuator, communication circuitry 215, and a controller 220. The controller 220 includes a processor 225 and the memory 140. The communication circuitry 215 is configured to communicate using wired and wireless communication approaches with devices remote from the garage door opener 100. For example, the communication circuitry 215 may include an antenna for communicating wirelessly with one or more of the transmitter 110, the keypad 115, the wall control 120, and the operator enhancement device 125. The communication circuitry 215 may also communicate using wired or wireless approaches with an object detector 227 (FIG. 1) such as photobeam components.

Figure 4:
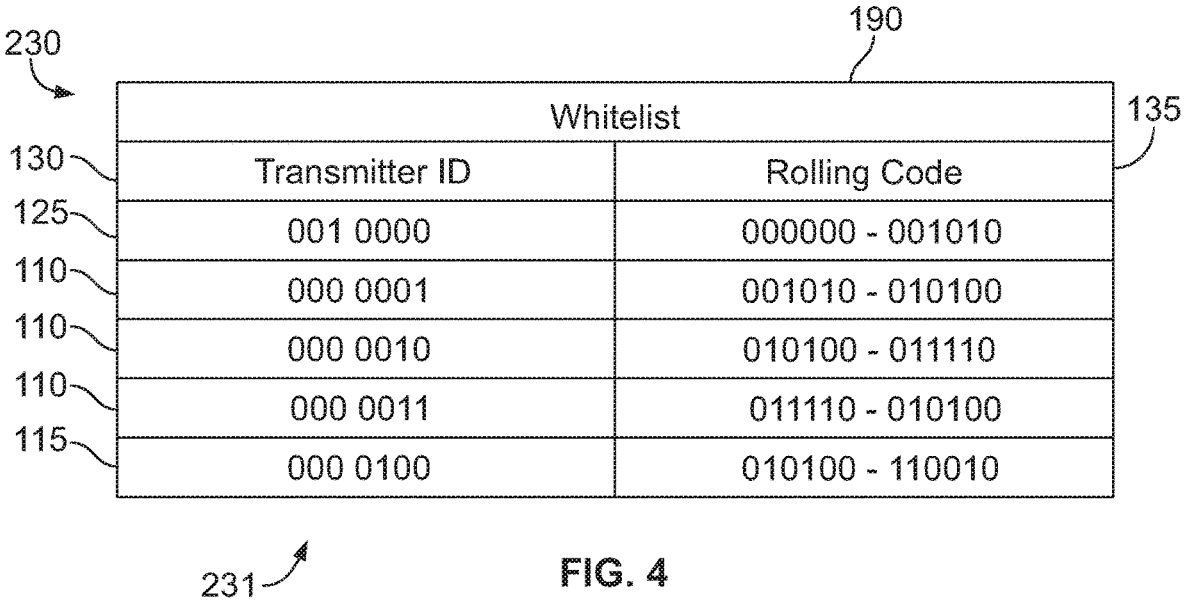
FIG. 4 is an example transmitter whitelist stored in a memory of the movable barrier operator of FIG. 3.

Regarding FIG. 4, when the user 175 causes the garage door opener 100 to learn a transmitter such as the operator enhancement device 125, the garage door opener 100 stores the transmitter ID 130 in a data structure 230 such as whitelist 190, in the memory 140. The whitelist may optionally include a range of expected rolling codes 135 or other data to predict the next rolling code received from the authorized transmitters. The whitelist 190 includes transmitter IDs 130 for the operator enhancement device 125, three transmitters 110, and the keypad 115.

The transmitter IDs 130 include most significant digits or bits digits 231 for each of the entries in the whitelist 190. In one embodiment, the most significant bytes 231 of the transmitter ID 130 of the operator enhancement device 125 is programmed by the manufacturer of the operator enhancement device to be "000." As discussed in greater detail below, the most significant bytes 231 of the transmitter ID 130 of the operator enhancement device 125 changes, e.g., indexes, upon the operator enhancement device 125 being reset or newly paired with a movable barrier operator. For example, the most significant bytes 231 index from "000" to "001" when the user pairs the operator enhancement device 125 with the garage door opener 100 for the first time. When the user subsequently resets the operator enhancement device 125, the most significant bytes 231 index to "002." Because the transmitter ID 130 of the operator enhancement device 125 changes when the user resets the operator enhancement device 125, the radio frequency control signals transmitted by the operator enhancement device 125 will be unable to operate the garage door opener 100 unless the user 175 causes the garage door opener 100 to re-learn the operator enhancement device 125.

In one embodiment, the most significant bytes 231 for the transmitters 110 and the keypad 115 are programmed by the manufacturers of the devices and do not change for the life of the devices. The fixed transmitter ID 130 for these transmitters may be acceptable because transmitters 110 and the keypad 115 are typically discarded or disposed rather than being sold or transferred to other users.

The controller 220 determines whether a radio frequency control command received by the communication circuitry 215 contains a transmitter ID 130 and the associated rolling code 135 stored in the whitelist 190 in the memory 140. If both the transmitter ID 130 and the rolling code 135 received match an entry in the whitelist 190, the controller 220 carries out the command by causing the motor 210 to move the garage door 105 between open and closed positions. As another example, if the controllable device is a light, the control command may be executed by turning the light on or off.

The operator enhancement device 125 provides improved security by changing the transmitter ID 130 of the operator enhancement device 125 in response to a transmitter ID change event, for example, when the operator enhancement device 125 is reset, such as one or more of entering into a factory reset mode, being removed from a user's user account (e.g. via the application 195), and deletion of a user's user account (e.g. by server computer 200). The user may cause the operator enhancement device 125 to enter the factory reset mode by pressing a reset button of the operator enhancement device 125. In this manner, the user may reset the operator enhancement device 125 before giving the operator enhancement device 125 to the user's neighbor (or another subsequent user) in order to change the transmitter ID 130 of the operator enhancement device. The operator enhancement device 125 will, upon change of the transmitter ID 130, be unable to operate the user's garage door opener 100 because the operator enhancement device 125 will now have a transmitter ID 130 different than the transmitter ID 130 learned by the garage door opener 100.

The operator enhancement device 125 may also provide improved security by changing the transmitter ID 130 in response to other transmitter ID change events, for example, when the operator enhancement device 125 is newly paired with a garage door opener 100. Thus, if the user 175 gives the operator enhancement device 125 to the user's neighbor, the operator enhancement device 125 will change the transmitter ID 130 of the operator enhancement device 125 upon the neighbor pairing the operator enhancement device 125 to the neighbor's garage door opener. The new transmitter ID 130 will not be stored in the whitelist 190 of the user's garage door opener 100. The original garage door opener 100 would therefore not recognize radio frequency control commands from the operator enhancement device 125 as being authorized.

Figure 5:
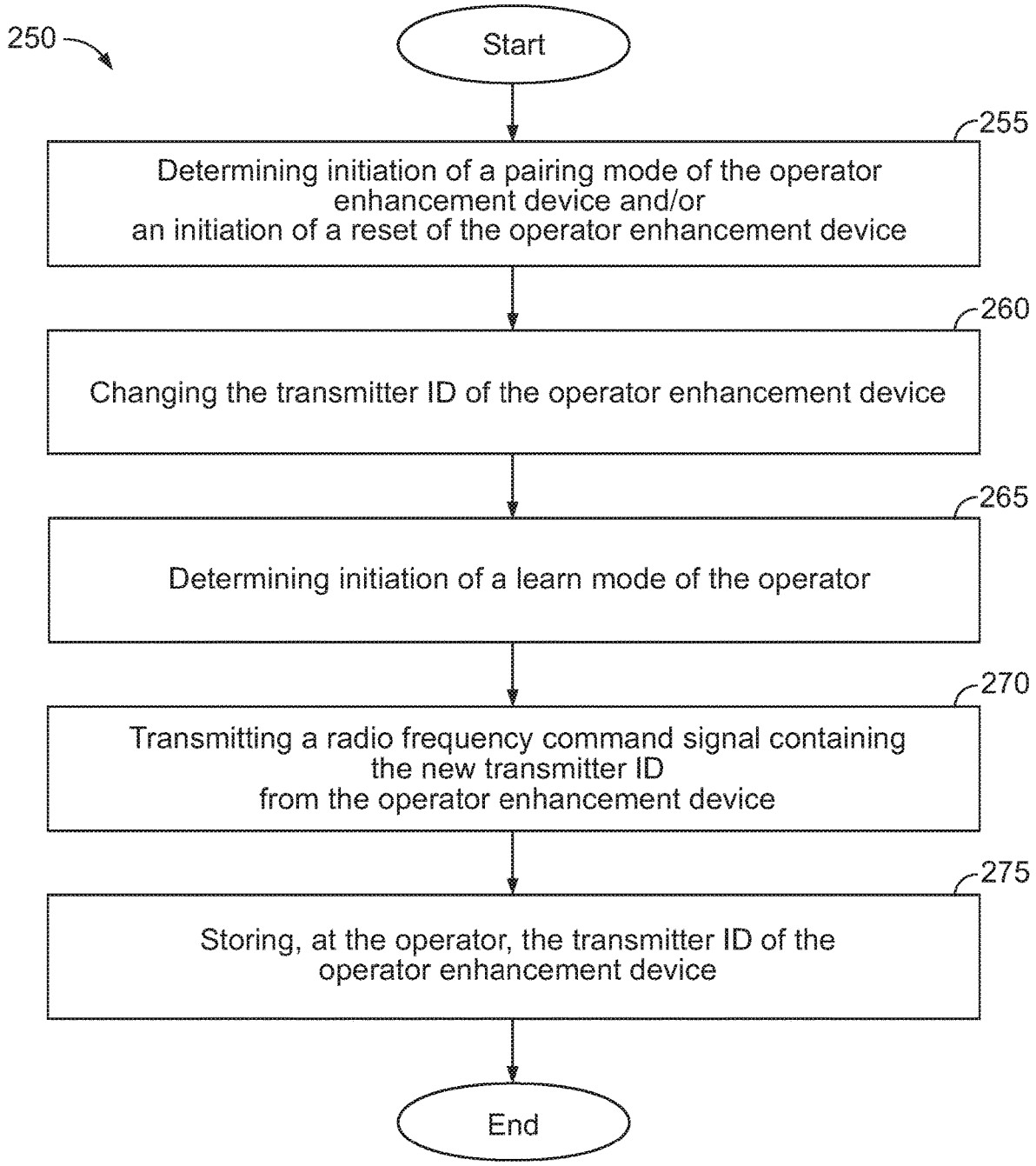
FIG. 5 is a flow chart of an example method that includes changing a transmitter ID of the operator enhancement device of FIG. 1.

With reference to FIG. 5, a method 250 is provided that includes changing the transmitter ID 130 of the operator enhancement device 125. The method 250 includes determining a transmitter ID change event, such as detecting or determining 255 an initiation of a pairing mode of the operator enhancement device 125 and/or initiation of a reset of the operator enhancement device 125. The pairing mode may be initiated 255 by a user pressing a physical or virtual button of the user interface 148 of the operator enhancement device 125. As another example, the pairing mode may be initiated by the user device 185 sending a pairing command to the operator enhancement device 125, either directly such as via Bluetooth®, or indirectly such as via the internet 155 and the server computer 200.

The initiation of the reset of the operator enhancement device 125 may be caused by the operator enhancement device 125 receiving a transmitter ID change request from the user device 185 or from the server computer 200. For example, a user may request a reset of the operator enhancement device 125 using the client application 195 instantiated on the user device 185 to cause the server computer 200 to send a transmitter ID change request to operator enhancement device 125. As another example, the resetting of the operator enhancement device 125 may be initiated 255 by pressing a physical or virtual button of the user interface 148 of the operator enhancement device 125 or by sending a reset request from the user device 185.

The method 250 includes changing 260 the transmitter ID 130 of the operator enhancement device 125 transmitter. The changing 260 may include changing the transmitter ID 130 from a first transmitter ID to a second transmitter ID that may be distinct, different, and/or unique from the first transmitter ID. The changing 260 may include changing all or a portion of the transmitter ID 130. The changing 260 may include indexing, such as incrementing or decrementing, the most significant bytes 231 of the transmitter ID 130 as discussed previously with respect to FIG. 4. The indexing may be performed according to a predetermined algorithm. In yet another example, the changing 260 may include randomly generating all or a portion of the transmitter ID 130. In another approach, the changing 260 includes indexing the least significant bytes of the transmitter ID 130. The changing 260 may also include deleting any record of the initial or previous transmitter ID 130 once the transmitter ID 130 has been changed. The changing 260 may also include changing or deleting a button ID of the operator enhancement device 125 transmitter.

The operator enhancement device 125 may be configured to control two or more garage door openers 100. To accommodate this operation, the manufacturer may provide the operator enhancement device 125 with two or more initial transmitter IDs 130 that are each associated with a different one of the garage door openers 100. The two or more initial transmitter IDs 130 are different to keep a radio frequency control command intended for one garage door opener 100 from operating another garage door opener 100. The initial transmitter IDs 130 are offset, such as by being spaced numerically by one, five, or ten digits.

When the operator enhancement device 125 is reset, the changing 260 may involve changing all of the transmitter IDs 130 of the operator enhancement device 125. For example, the changing 260 may include incrementing both transmitters IDs 130 by the same value to maintain the offset between the numerical values of the transmitter IDs 130. This approach keeps the transmitter IDs 130 from overlapping. In another approach, the two or more transmitter IDs 130 are spaced apart numerically, such as one digit, and the changing 260 includes incrementing the higher numerical value transmitter ID 130 and decrementing the lower numerical value transmitter ID 130.

Alternatively or additionally, when the user 175 changes the operator enhancement device 125 from being paired with one garage door opener to another garage door opener, the changing 260 may involve changing only the transmitter ID 130 that was associated with the one garage door opener. For example, the operator enhancement device 125 may have a first transmitter ID 130 associated with a first garage door opener and a numerically larger second transmitter ID 130 associated with a second garage door opener. Upon the user 175 changing the operator enhancement device 125 from being paired with the second garage door opener to a third garage door opener, the second transmitter ID 130 would be incremented while the first transmitter ID 130 would remain unchanged and continue to operate the first garage door opener. Likewise, the changing 260 may involve changing only one of the transmitter IDs 130 of the operator enhancement device 260 when the user 175 deletes, using the application 195, a connection between the operator enhancement device 125 and a garage door opener associated with the one transmitter ID 130.

The changing 260 may include the processor 144 determining all or a portion of the new transmitter ID 130. In another approach, the changing 260 involves the operator enhancement device 125 receiving all or a portion of a new transmitter ID 130 from a remote device such as the user device 185 or the server computer 200.

Once the transmitter ID 130 of the operator enhancement device 125 has been changed at operation 260, any garage door openers 100 formerly associated with the operator enhancement device 125 will no longer actuate in response to a radio frequency control command from the operator enhancement device 125. This is because the new transmitter ID 130 of the operator enhancement device 125 is not in the memory 140 of the garage door opener 100.

To setup the operator enhancement device 125 to operate a new garage door opener, the new garage door opener learns the operator enhancement device 125. The learning process may involve detecting or determining 265 initiation of a learn mode of the new garage door opener and transmitting 270 a radio frequency control command from the operator enhancement device 125 to the new garage door opener. The radio frequency control command includes the new transmitter ID 130 obtained at operation 260. The new garage door opener may then store 275 the new transmitter ID 130 and all or a portion of the rolling code 135 in a memory of the new garage door opener.

While the above example method describes the method using operator enhancement device 125, one or more of the transmitters 110 may also be configured to change the transmitter ID 130 of the transmitter 110 upon the transmitter 110 being reset, receiving a pairing command, and/or otherwise determining that the transmitter 110 is being paired or learned by a movable barrier operator. For example, a user desiring that the transmitter 110 no longer control the currently associated garage door opener 100 may put the transmitter 110 into a reset mode. The transmitter 110 then generates a new transmitter ID 130. Then, to associate the transmitter 110 with a new garage door opener, the user causes the new garage door opener to enter a learn mode and causes the transmitter to send a radio frequency command signal. The new garage door opener may thereby learn the transmitter 110.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass only A, only B, or both A and B.

While there have been illustrated and described particular embodiments of the present invention, it will be appreciated that numerous changes and modifications will occur to those skilled in the art, and it is intended for the present invention to cover all those changes and modifications which fall within the scope of the appended claims.

What is claimed is:

1. A movable barrier operator enhancement device comprising:

communication circuitry configured to transmit a radio frequency control signal to a movable barrier operator;

a memory configured to store a first transmitter identification (ID) and a changing code for the radio frequency control signal;

a processor operatively coupled to the memory and the communication circuitry, the processor configured to change the first transmitter ID to a different, second transmitter ID in response to a determination of a transmitter ID change event;

the communication circuitry configured to receive a state change request for the movable barrier operator from a remote server computer via the internet; and the processor configured to cause the communication circuitry to transmit a radio frequency control signal including the second transmitter ID and the changing code to the movable barrier operator in response to the communication circuitry receiving the state change request.

2. The movable barrier operator enhancement device of claim 1 further comprising a user interface configured to receive a user input; and wherein the processor is configured to determine the transmitter ID change event in response to the user interface receiving the user input.

3. The movable barrier operator enhancement device of claim 2 wherein the user interface includes a button configured to receive the user input.

4. The movable barrier operator enhancement device of claim 1 wherein the processor is configured to be placed in a learning mode; and wherein the processor is configured to determine the transmitter ID change event in response to the processor being placed in the learning mode.

5. The movable barrier operator enhancement device of claim 1 wherein the processor is configured to change the first transmitter ID to the second transmitter ID by incrementing or decrementing the first transmitter ID.

6. The movable barrier operator enhancement device of claim 1 wherein the communication circuitry is configured to transmit a second radio frequency control signal to a second movable barrier operator;

the memory is configured to store a third transmitter identification (ID) for the second radio frequency control signal;

the processor is configured to change the third transmitter ID to a fourth transmitter ID in response to the determination of the transmitter ID change event; and wherein the first and third transmitter IDs are different from one another and the second and fourth transmitter IDs are different from one another.

7. The movable barrier operator enhancement device of claim 6 wherein the processor is configured to change the first transmitter ID to the second transmitter ID by a first value and change the third transmitter ID to the fourth transmitter ID by a second value similar to the first value.

8. The movable barrier operator enhancement device of claim 1 wherein the processor is configured to delete the first transmitter ID from the memory upon changing the first transmitter ID to the second transmitter ID.

9. The movable barrier operator enhancement device of claim 1 wherein the communication circuitry is configured to receive, via a network, a transmitter ID change request from a server computer; and wherein the processor is configured to determine the transmitter ID change event in response to the communication circuitry receiving the transmitter ID change request.

10. The movable barrier operator enhancement device of claim 1 wherein the communication circuitry is configured to receive a transmitter ID change request from a user device; and wherein the processor is configured to determine the transmitter ID change event in response to the communication circuitry receiving the transmitter ID change request.

11. The movable barrier operator enhancement device of claim 1 in combination with a movable barrier position sensor configured to provide a signal to the communication circuitry indicative of a state of a movable barrier associated with the movable barrier operator; and wherein the processor is configured to cause the communication circuitry to communicate movable barrier status information to the remote server computer.

12. The movable barrier operator enhancement device of claim 1 in combination with a movable barrier position sensor configured to provide a signal to the communication circuitry indicative of a state of a movable barrier associated with the movable barrier operator; and wherein the processor is configured to determine a current state of the movable barrier and compare the current state to a state of the movable barrier associated with the state change request, the processor further configured to refrain from causing the communication circuitry to transmit the radio frequency control signal upon the current state of the movable barrier corresponding to the state of the movable barrier associated with the state change request.

13. The movable barrier operator enhancement device of claim 1 wherein the transmitter ID change event includes a reset of the movable barrier operator enhancement device.

14. The movable barrier operator enhancement device of claim 1 further comprising a reset button;

wherein the processor is configured to cause a reset of the movable barrier operator enhancement device in response to the reset button being actuated by a user; and wherein the transmitter ID change event includes the reset of the movable barrier operator enhancement device.

15. The movable barrier operator enhancement device of claim 1 wherein the transmitter ID change event includes the movable barrier operator enhancement device pairing with a movable barrier operator for a first time.

16. The movable barrier operator enhancement device of claim 1 wherein the transmitter ID change event includes the movable barrier operator enhancement device being removed from a user account.

17. A method of operating a movable barrier operator enhancement device, the movable barrier operator enhancement device having communication circuitry configured to transmit a radio frequency control signal to a movable barrier operator and a memory configured to store a first transmitter identification (ID) and a changing code for the radio frequency control signal, the method comprising:

at the movable barrier operator enhancement device:

changing the first transmitter ID to a different, second transmitter ID in response to a determination of a transmitter ID change event;

receiving a state change request for the movable barrier operator from a remote server computer via the internet; and transmitting a radio frequency control signal including the second transmitter ID and the changing code to the movable barrier operator in response to the state change request.

18. The method of claim 17 further comprising:

receiving a user input at a user interface of the movable barrier operator enhancement device; and determining the transmitter ID change event in response to the user interface receiving the user input.

19. The method of claim 18 wherein the user interface includes a button; and wherein receiving the user input at the user interface includes detecting user operation of the button.

20. The method of claim 17 further comprising determining the transmitter ID change event in response to the movable barrier operator enhancement device being placed in a learning mode.

21. The method of claim 17 wherein changing the first transmitter ID to the second transmitter ID includes incrementing or decrementing the first transmitter ID.

22. The method of claim 17 wherein the communication circuitry is configured to transmit a second radio frequency control signal to a second movable barrier operator and the memory is configured to store a third transmitter identification (ID) for the second radio frequency control signal, the method further comprising:

changing the third transmitter ID to a fourth transmitter ID in response to the determination of the transmitter ID change event;

wherein the first and third transmitter IDs are different from one another and the second and fourth transmitter IDs are different from one another.

23. The method of claim 22 wherein changing the first transmitter ID to the second transmitter ID includes changing the first transmitter ID to the second transmitter ID by a first value; and wherein changing the third transmitter ID to the fourth transmitter ID includes changing the third transmitter ID to the fourth transmitter ID by a second value similar to the first value.

24. The method of claim 17 further comprising deleting the first transmitter ID from the memory of the movable barrier operator enhancement device upon changing the first transmitter ID to the second transmitter ID.

25. The method of claim 17 further comprising:

receiving a transmitter ID change request from a server computer via a network; and determining the transmitter ID change event in response to receiving the transmitter ID change request.

26. The method of claim 17 further comprising receiving a transmitter ID change request from a user device; and determining the transmitter ID change event in response to the communication circuitry receiving the transmitter ID change request.

27. The method of claim 17 further comprising:

receiving a signal from a movable barrier position sensor indicative of a state of a movable barrier associated with the movable barrier operator; and communicating movable barrier status information to the remote server computer.

28. The method of claim 17 further comprising:

receiving a signal from a movable barrier position sensor indicative of a state of a movable barrier associated with the movable barrier operator;

determining a current state of the movable barrier based at least in part upon the signal;

comparing the current state of the movable barrier to a state of the movable barrier associated with the state change request; and refraining from transmitting the radio frequency control signal upon the current state of the movable barrier corresponding to the state of the movable barrier associated with the state change request.

* * * * *